US005743332A

United States Patent [19]

Lam et al.

[11] Patent Number: 5,743,332

[45] Date of Patent: Apr. 28, 1998

[54] INTEGRAL WELLHEAD ASSEMBLY FOR PUMPING WELLS

[75] Inventors: Tony M. Lam; Keith D. Farquharson, both of Edmonton, Canada

[73] Assignee: Stream-Flo Industries Ltd., Edmonton, Canada

[21] Appl. No.: 602,994

[22] Filed: Feb. 16, 1996

[51] Int. Cl.[6] ..... E21B 34/02

[52] U.S. Cl. ..... 166/85.4; 166/97.1; 166/379

[58] Field of Search ..... 166/85.1, 85.4, 166/97.1, 75.13, 379; 137/861; 251/1.1, 1.2, 1.3

[56] References Cited

U.S. PATENT DOCUMENTS 3,050,126 8/1962 LeBeaux et al. ..... 166/97.1

4,125,164 11/1978 Terry ..... 166/85.4 X

OTHER PUBLICATIONS

Griffin Brochure, *Progressing Cavity Pumps*, Jun. 1995.

Corod Brochure, *Rotalift Wellhead Drive Units*, Jun. 1996.

*Primary Examiner*—David J. Bagnell
*Attorney, Agent, or Firm*—Sheridan Ross P.C.

[57] ABSTRACT

The adapter, blow-out preventer housing and flow tee of an oilwell wellhead assembly are formed together as a one-piece or integral structure. The structure has a bottom flanged connection and a top studded and internally threaded connection. By eliminating threaded connections and the adapter body, the length of the combined assembly is reduced by about 50% and structural strength is improved.

2 Claims, 5 Drawing Sheets

INTEGRAL WELLHEAD ASSEMBLY FOR PUMPING WELLS

FIELD OF THE INVENTION

This invention relates to that segment of a wellhead assembly comprising the tubing adapter, tubing blow-out preventer, flow tee and top and bottom connections.

BACKGROUND OF THE INVENTION

A conventional oilwell wellhead assembly is illustrated in FIG. 1. The assembly comprises:

A tubular casing bowl, which is mounted to the upper end of the well casing. The bottom end of the casing bowl is threaded, for screwing onto the externally threaded casing. It has side-opening ports, to provide access to the annular space between the casing string and the tubing string. At its upper end, the casing bowl has a flanged connection;

A tubular tubing head, having flanged connections at both ends, mounts on the casing bowl. The lower flanged connection of the tubing head is bolted onto the casing bowl flanged connection. The internal bore of the tubing head is formed to support a tubing hanger, from which the tubing string is suspended. Side-opening, internally threaded ports are provided in the tubing head wall to provide access to the annular space between the casing and tubing strings;

A tubular tubing head adapter, having a flanged lower connection and an internally threaded upper connection, is bolted onto the flanged upper connection of the tubing head. The adapter provides a transition from a flanged connection to a threaded connection;

A tubular blow-out preventer unit is mounted on the adapter. This BOP unit comprises a body, having top and bottom threaded connections, and side-opening, internally threaded ports for receiving the ram assemblies of the BOP; and A tubular flow tee is mounted onto the BOP unit. The flow tee has internally threaded top and bottom connections and a side-opening, internally threaded port for connection with a flow line through which fluid from the tubing string is produced.

In recent years, many pumping oilwells have been equipped with rotary downhole pumps, sometimes referred to as progressive cavity pumps, for pumping the produced fluid. These pumps are powered by a rotating rod string extending through the vertical through-bore of the wellhead assembly. A frame is mounted to the flow tee. A stuffing box is positioned within the frame and mounted to the top connection of the flow tee. The stuffing box seals around the polish rod of the rod string, which extends from the wellhead assembly. The polish rod protrudes through the stuffing box and frame and is drivably engaged by a drive means linking the polish rod with a motor. The term "rotary pump drive assembly" is used herein to denote the assembly comprising the frame, drive means and motor.

The motor is offset from the axis of the wellhead assembly. Since the motor vibrates, this introduces a cyclical bending moment which is applied to the wellhead structure. This bending moment increases as the length of the adapted/BOP unit/flow tee structure increases in length. As a result of these factors, failures have occurred, particularly at the connection between the tubing head adapter and the BOP unit.

To our knowledge, the only prior solution offered in the industry to cope with this problem has been to weld up the threaded connections, to thereby strengthen them.

It is the object of this invention to provide a novel adapter/BOP unit/flow tee structure which is more compact and better able to withstand cyclical stresses induced by the rotary drive assembly.

SUMMARY OF THE INVENTION

In accordance with the invention, the tubing head adapter, BOP unit, flow tee bottom connections are formed as a one-piece or integral unit. The unitary structure may be formed from a single piece of steel, forged or cast. The new structure a bottom flanged connection for connecting directly to the tubing head, accommodates BOP componentry, has outlets for diverting the flow horizontally and has a top connection, preferably studded and internally threaded, for connecting with a rotary pump drive assembly and stuffing box.

By forming the adapter/BOP/flow tee structure in this way, we have realized the following advantages:

A comparative vertical length saving of about 50% is achieved by eliminating the threaded connections and the body of the adapter. This brings the rotary drive assembly closer to ground surface, which is advantageous for servicing, and significantly reduces the bending moment; and By not having the end-to-end threaded or flanged connections of the prior art assemblies, the structure is stronger, and thus is better able to support a rotary pump drive assembly.

DESCRIPTION OF THE PREFERRED EMBODIMENT

Figure 1:
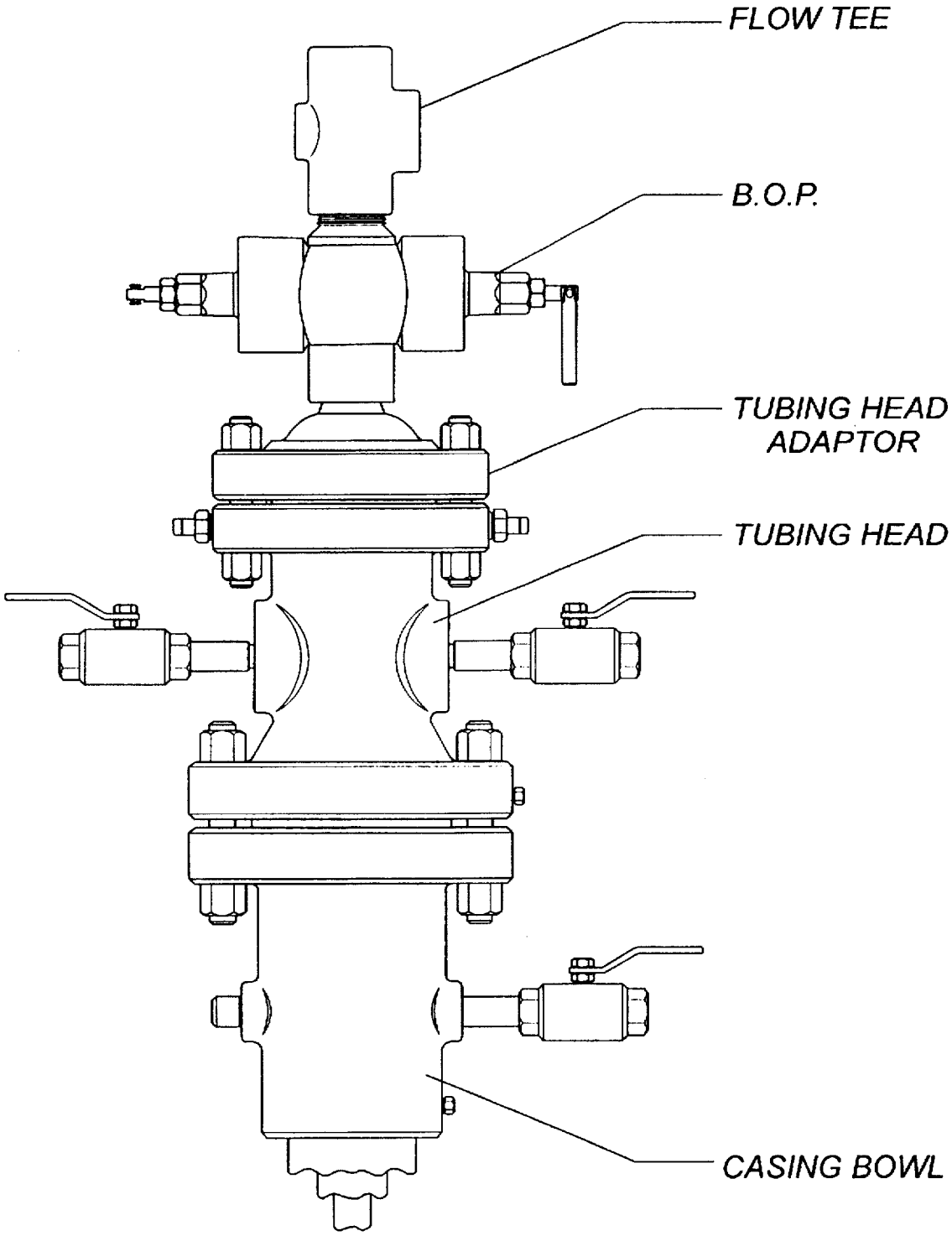
FIG. 1. (Prior Art)
FIG. 1 is a side view of a prior art wellhead assembly.
Figure 2:
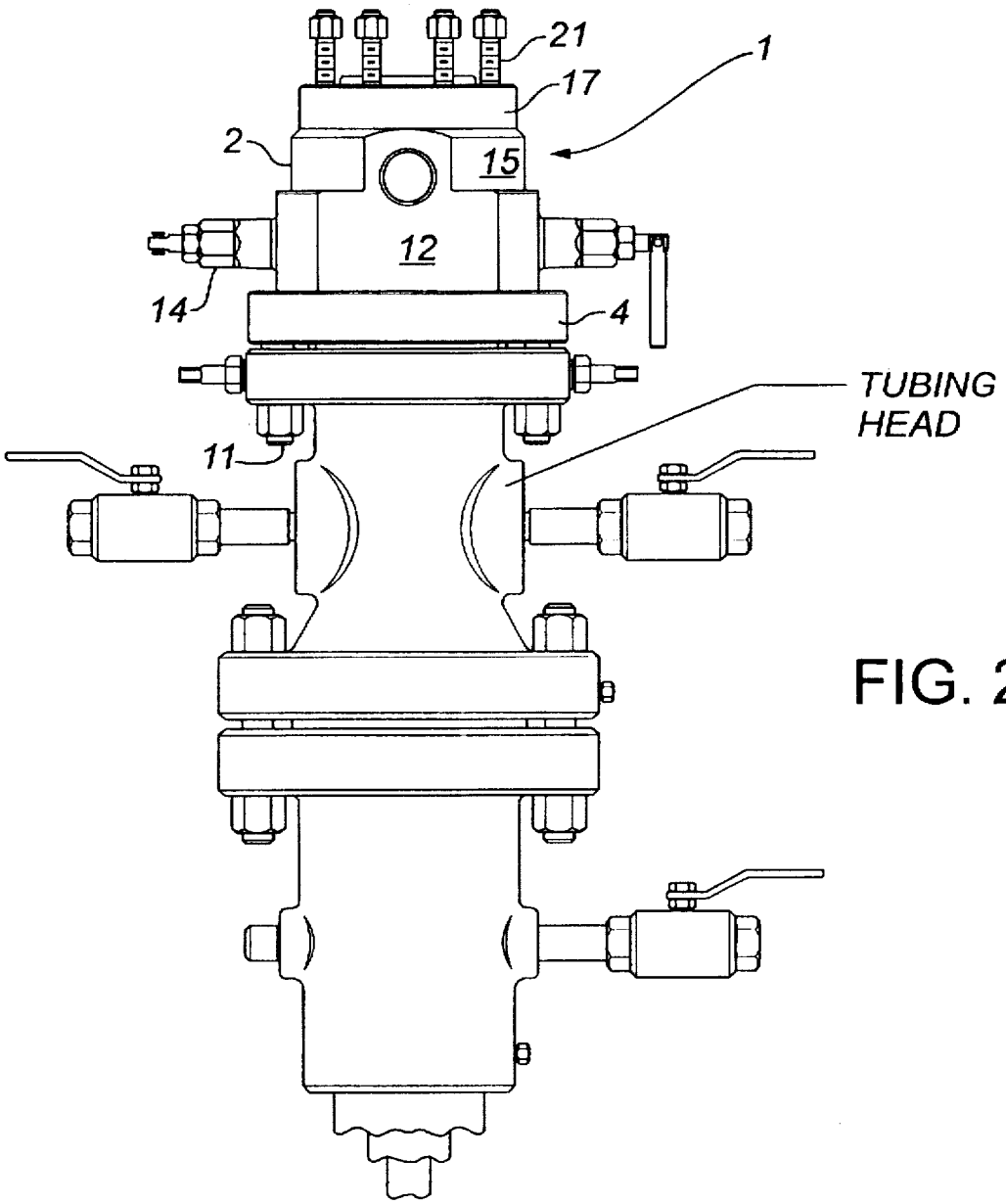
FIG. 2 is a view similar to FIG. 1, showing a unitary adapter/BOP/flow tee structure.
Figure 3:
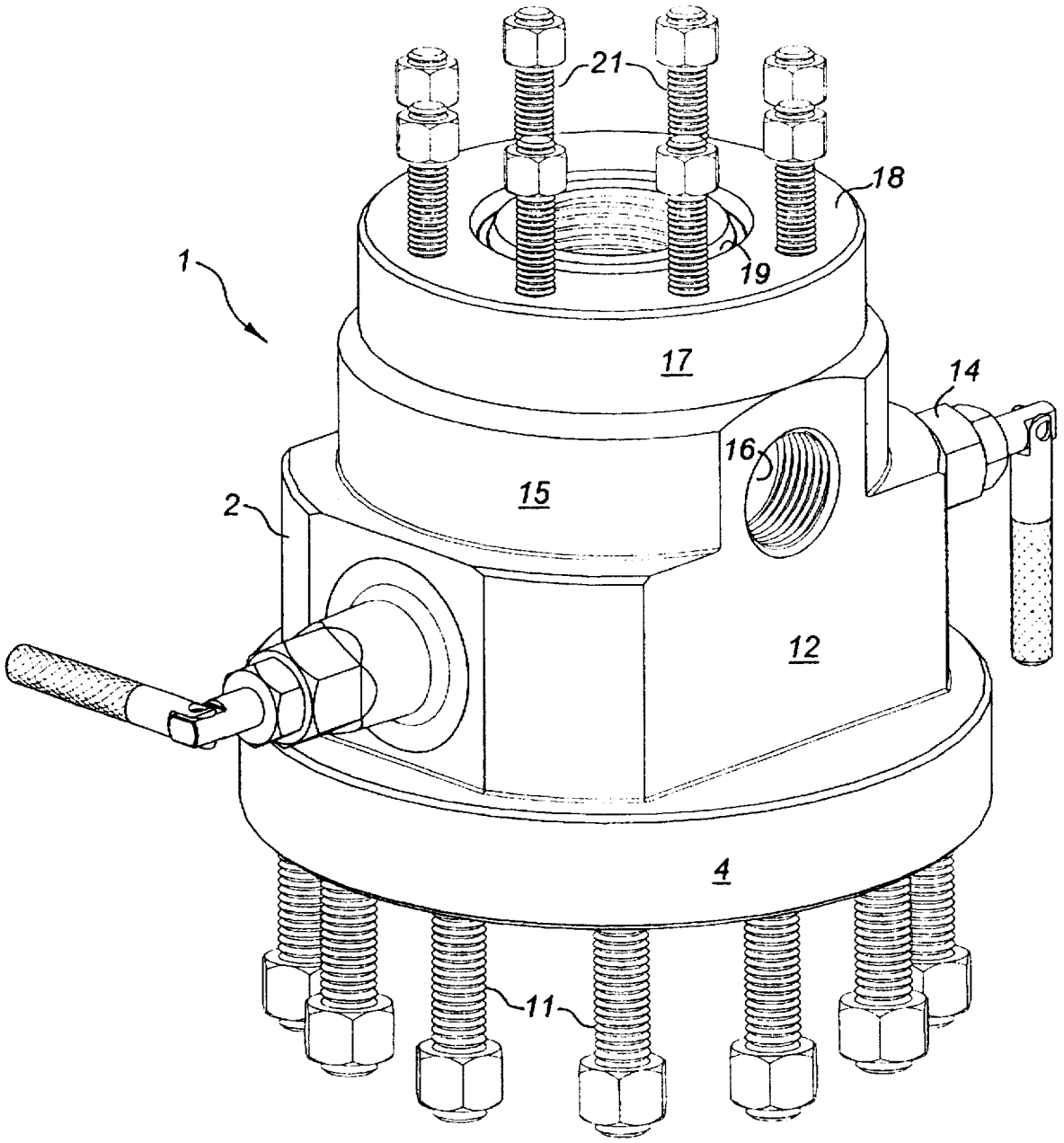
FIG. 3 is a perspective view of the structure.
Figure 4:
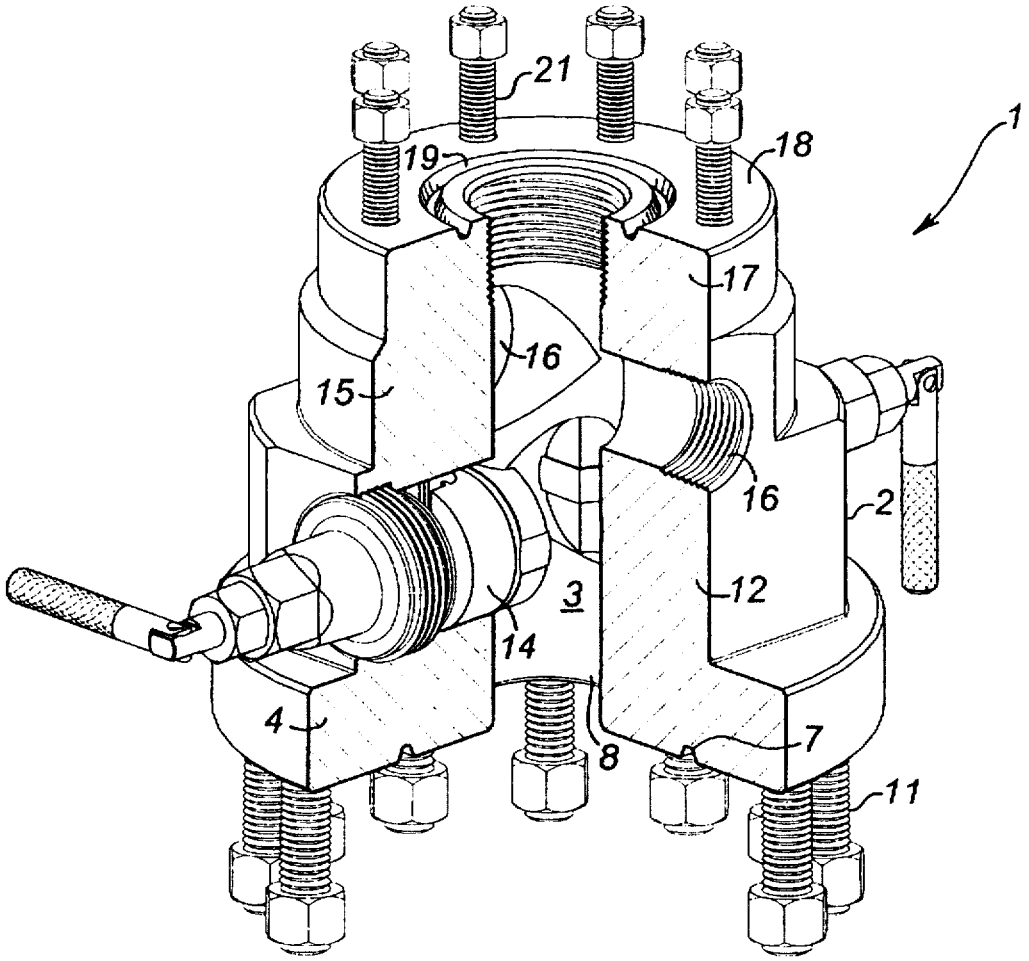
FIG. 4 is a perspective, partly broken away view of the structure.
Figure 5:
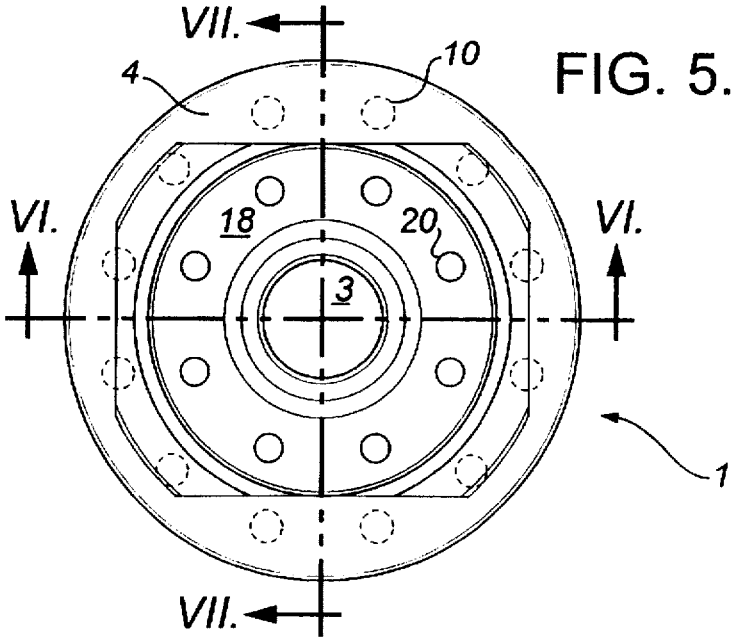
FIG. 5 is a top plan view of the structure.
Figure 6:
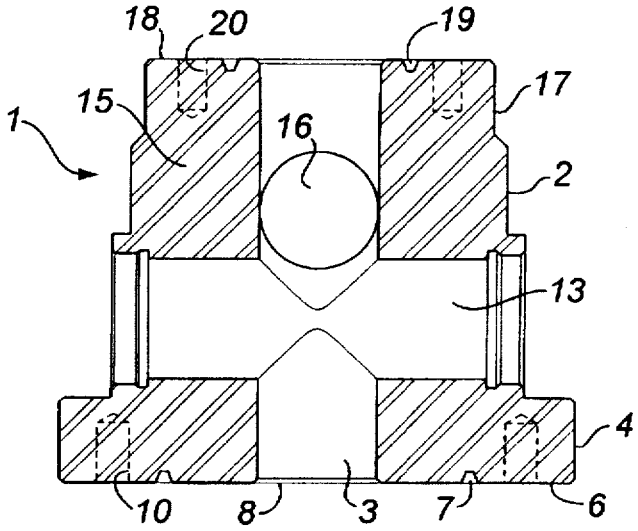
FIG. 6 is a sectional side view taken along the line VI—VI of FIG. 5.
Figure 7:
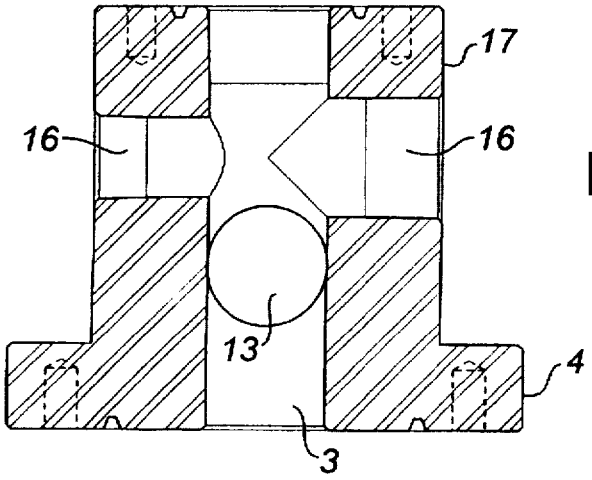
FIG. 7 is a sectional side view taken along the line VII—VII of FIG. 5.

The adapter/BOP/flow tee structure 1 comprises an integral or one-piece, tubular housing 2 forming a vertical bore 3 extending therethrough. The housing 2 is not formed of tubular parts connected end to end by threaded connections, but instead is formed from a single piece of steel.

The housing 2 comprises a bottom flanged connection 4. This bottom connection 4 is adapted to mount to the top flanged connection of a tubing head. The face 6 of the connection 4 forms a seal ring groove 7 extending around the vertical bore inlet 8. The connection 4 also forms bolt holes 10 for receiving connecting studs 11.

A housing first section 12 extends up from the bottom connection 4. The first section 12 forms diametrically aligned side openings 13 communicating with the vertical bore 3. The side openings 13 are internally threaded and formed to receive the ram components 14 of a side-opening BOP to provide emergency shut-off means, if required.

A housing second section 15 extends up from the first section 12. The second section 15 forms internally threaded side openings 16 communicating with the vertical bore 3. The side openings 16 form flow tee outlet means for tying in to a flow line (not shown) through which well fluid is produced.

An internally threaded top connection 17 extends up from the second section 15. The face 18 of connection 17 forms a ring seal groove 19 and bolt holes 20 for studs 21.

In summary, the structure 1 is adapted to bolt to the top flanged connection of a tubing head and to connect to the frame and stuffing box of a rotary pump drive assembly. It provides the functions of adapter, blow-out preventer components housing and flow tee.

The embodiments of the invention in which an exclusive property or privilege is claimed are defined as follows:

1. An adapted/BOP/flow tee structure for mounting to a top flanged connection of a pumping well wellhead assembly tubing head and connecting with a rotary pump drive assembly and stuffing box, comprising:

an integral steel housing forming a vertical bore extending therethrough, said housing comprising from bottom to top, a bottom flanged connection having means for enabling mounting to the top flanged connection of the tubing head, a first housing section forming side openings, extending into the vertical bore, for receiving the ram components of a side-opening blow-out preventer, a flow tee section forming at least one side opening, communicating with the vertical bore, for producing well fluid, and a top connection for connection with the rotary pump drive assembly and stuffing box.

2. The adapter/BOP flow tee structure as set forth in claim 1 wherein:

the top connection is studded and internally threaded.

* * * * *